US008225621B2

(12) United States Patent
DiFatta et al.

(10) Patent No.: US 8,225,621 B2
(45) Date of Patent: Jul. 24, 2012

(54) DETECTION AND CORRECTION OF REVERSE OPERATION OF A COMPRESSOR IN A REFRIGERATION SYSTEM

(75) Inventors: Vincenzo DiFatta, Wood Dale, IL (US); Daniel D. Prochaska, Sr., Elgin, IL (US); Christopher J. Knight, Lisle, IL (US); Wali Li, Naperville, IL (US); Nikolay V. Popov, Warrenville, IL (US)

(73) Assignee: IMI Cornelius, Inc., Glendale Heights, IL (US)

( * ) Notice: Subject to any disclaimer, the term of this patent is extended or adjusted under 35 U.S.C. 154(b) by 662 days.

(21) Appl. No.: 12/454,821

(22) Filed: May 22, 2009

(65) Prior Publication Data

US 2009/0292395 A1 Nov. 26, 2009

Related U.S. Application Data

(60) Provisional application No. 61/128,796, filed on May 23, 2008.

(51) Int. Cl.

| | |
|---|---|
| ***F25B 1/00*** | (2006.01) |
| ***F25B 49/00*** | (2006.01) |
| ***G01K 13/00*** | (2006.01) |

(52) U.S. Cl. ..... 62/228.3; 62/129; 62/228.1

(58) Field of Classification Search ..... 62/238.1, 62/238.3, 234, 129; 700/275; 418/55.1
See application file for complete search history.

(56) References Cited

U.S. PATENT DOCUMENTS 6,205,798 B1 * 3/2001 Porter et al. ..... 62/129
2006/0026973 A1 * 2/2006 Atchison et al. ..... 62/129

* cited by examiner

*Primary Examiner* — Chen Wen Jiang
(74) *Attorney, Agent, or Firm* — Niro, Haller & Niro

(57) ABSTRACT

A method and system for detecting and correcting unintended reverse or backward operation of an electric motor driven scroll compressor of a refrigeration system is characterized by monitoring the pressure at a suction side of the compressor during operation of the refrigeration and determining whether the pressure, after a first time interval following startup of the compressor, exceeds and remains in excess of a predetermined upper pressure limit for at least a second time interval. If it does, the compressor is turned off for a third time interval and is then restarted. The foregoing is repeated and if the compressor is turned off a selected number of times because of successive occurrences of high suction side pressures during operation of the refrigeration system in a chilling cycle, an error indication is generated and the refrigeration system is shut down.

18 Claims, 3 Drawing Sheets

DETECTION AND CORRECTION OF REVERSE OPERATION OF A COMPRESSOR IN A REFRIGERATION SYSTEM

This application claims benefit of provisional patent application Ser. No. 61/128,796, filed May 23, 2008.

FIELD OF THE INVENTION

The present invention relates to refrigeration systems that utilize a compressor, and in particular to a control system for detecting and correcting unintended reverse operation of a compressor of a refrigeration system.

BACKGROUND OF THE INVENTION

Refrigeration systems having scroll compressors are used in various applications, for example to provide chilling of freeze barrels or cylinders in frozen product machines, such as frozen beverage dispensers. An evaporator of the refrigeration system is heat transfer coupled to a freeze barrel, and the refrigeration system chills the evaporator during a chilling cycle of the freeze barrel to chill and freeze product in the barrel. The refrigeration system is also operable to heat the evaporator during a defrost cycle of the barrel to warm and defrost product in the barrel.

During operation of a refrigeration system having an electric motor driven scroll compressor, for example a refrigeration system used in a frozen product machine, the motor driven compressor is cycled on and off. Normally, with an uninterrupted power supply and controlled on/off cycling of the motor driven compressor, the time between turning the compressor off and turning it on again is sufficient for refrigerant pressures in the system to generally equalize, so that when the motor is turned on again, it will rotate the compressor in its proper and intended direction of rotation. However, it can happen that if there is a brief and transient loss of electric power during a chilling cycle of the refrigeration system, during which chilling cycle the pressure of refrigerant on the high side of the scroll compressor is considerably greater than the pressure on the low or suction side, in the short period while electric power is off a flow of refrigerant from the high to the suction side of the scroll compressor can rotate the compressor and its drive motor backward. Should electric power be restored while the drive motor and compressor are rotating backward, the electric motor can be energized in a reverse direction of rotation, such that it then rotates the scroll compressor backward in a reverse mode opposite from its intended and proper direction of rotation. Should reversal of compressor operation occur, the pressure on its suction side will begin to rise above a known limit prescribed for normal operation of the compressor, with an attendant loss of refrigeration and eventual overheating and unexpected shutdown of the refrigeration system.

OBJECT OF THE INVENTION

A primary object of the present invention is to provide a control system for detecting the occurrence of operation of an electric motor driven scroll compressor of a refrigeration system in a reverse mode, and for then operating motor driven compressor in a manner to return the compressor to its intended direction of rotation.

SUMMARY OF THE INVENTION

In accordance with the present invention, a controller for a refrigeration system having an electric motor driven compressor comprises means for monitoring refrigerant pressure at a suction side of the compressor; means responsive to monitored suction pressure being at least equal to a predetermined pressure at selected times after the motor driven compressor is turned on for turning off the motor driven compressor; and means for turning on the motor driven compressor a predetermined time after the means responsive turns off the compressor.

In a contemplated embodiment of the invention, a control system for a refrigeration system having an electric motor driven compressor comprises means for sensing whether the compressor is on; first means for determining whether compressor suction side pressure is at least equal to a predetermined pressure at the end of a first time interval following sensing that the compressor is on; second means for determining whether compressor suction side pressure is at least equal to the predetermined pressure at the end of a second time interval following a determination at the end of the first time interval that compressor suction side pressure is at least equal to the predetermined pressure; means for turning off the motor driven compressor for a third time interval in response to a determination at the end of the second time interval that compressor suction side pressure is at least equal to the predetermined pressure; and means for turning on the motor driven compressor at the end of the third time interval.

The electric motor driven compressor is a scroll compressor, the refrigeration system is operable in both chilling and defrost cycles, the sensing means senses whether the compressor is on in a defrost cycle of the refrigeration system, and the first means for determining is responsive to the sensing means sensing that the compressor is on, but not in a defrost cycle of the refrigeration system, to determine whether compressor suction side pressure is at least equal to the predetermined pressure at the end of the first time interval. A counter means may be provided for storing a count of the number of successive times that the compressor is turned off by the means for turning off the compressor, along with means responsive to the count in the counter means reaching a selected count to terminate operation of the refrigeration system.

In a more specific embodiment of the apparatus of the invention, a refrigeration system has an electric motor driven scroll compressor operable in chilling and defrost cycles of the refrigeration system. In this more specific embodiment, the refrigeration system comprises means for energizing the electric motor to turn on the compressor; means for monitoring refrigerant pressure at a suction side of the compressor; first timer means responsive to the compressor being turned on in a chilling cycle of the refrigeration system to initiate timing of a first time interval; and first means for comparing monitored compressor suction side pressure to a predetermined pressure and for generating a first signal if the monitored pressure is at least equal to the predetermined pressure at the end of the first time interval. Also included is second timer means responsive to generation of the first signal to initiate timing of a second time interval; second means for comparing monitored compressor suction side pressure to the predetermined pressure and for generating a second signal if the monitored pressure is at least equal to the predetermined pressure at the end of the second time interval; means responsive to generation of the second signal for de-energizing the electric motor to turn off the compressor; third timer means responsive to generation of the second signal for initiating timing of a third time interval; and means for re-energizing the electric motor at the end of the third time interval to turn on the compressor in a chilling cycle of the refrigeration system.

The invention also contemplates a method of controlling a refrigeration system having an electric motor driven scroll compressor, which method comprises the steps of energizing the electric motor to operate the compressor; monitoring refrigerant pressure at a suction side of the compressor; determining whether monitored refrigerant pressure is at least equal to a predetermined pressure both after expiration of a first time interval following energization of the motor and after expiration of a second time interval following expiration of the first time interval; de-energizing the motor to turn off the compressor for a third time interval in response to the determining step determining that monitored compressor suction side pressure is at least equal to the predetermined pressure after expiration of each of the first and second time intervals; and re-energizing the electric motor to operate the compressor following expiration of the third time interval.

A more specific practice of the method of the invention is for controlling a refrigeration system having an electric motor driven scroll compressor operable in chilling and defrost cycles of the refrigeration system. In this more specific case, the method comprising the steps of energizing the electric motor to turn on the compressor; monitoring refrigerant pressure at a suction side of the compressor; sensing whether the compressor is on in a defrost cycle of the refrigeration system; initiating timing of a first time interval in response to the sensing step sensing that the compressor is on and not in a defrost cycle of the refrigeration system; and determining, after expiration of the first time interval, whether monitored pressure at the suction side of the compressor is at least equal to a predetermined pressure. Also included are the steps of initiating timing of a second time interval in response to the determining step determining that monitored compressor suction side pressure is at least equal to the predetermined pressure after expiration of the first time interval; ascertaining, after expiration of the second time interval, whether monitored compressor suction side pressure is at least equal to the predetermined pressure; turning off the compressor in response to the ascertaining step ascertaining that monitored compressor suction side pressure is at least equal to the predetermined pressure after expiration of the second time interval; initiating timing of a third time interval in response to performance of the turning off step; and re-energizing the electric motor to turn on the compressor in a chilling cycle of the refrigeration system after expiration of the third time interval.

Advantageously included are the steps of counting the number of times of expiration of the third time interval; and terminating operation of the refrigeration system upon the counting step reaching a selected count.

The foregoing and other objects advantages and features of the invention will become apparent upon a consideration of the following detailed description when taken in conjunction with the accompanying drawings.

DETAILED DESCRIPTION

The invention advantageously provides a control system for automatically restoring proper operation of a refrigeration system utilizing an electric motor driven scroll compressor, such for example as a refrigeration system for a frozen product machine, following an unintended reversal in the direction of rotation of the compressor. The control system detects and resolves an occurrence of a reversal in the intended direction of operation the scroll compressor, which reversal can occur as a result of a brief or transient loss of electrical power to the compressor motor during a refrigeration cycle. Should there be an intermittent loss of power to the motor and a reversal in the direction of rotation of the compressor, absent correction the result will be a loss of refrigeration with eventual overheating and unexpected shutdown of the refrigeration system.

A motor driven scroll compressor has a high pressure discharge side and a lower pressure suction side. Should a reversal occur in the direction of operation of the compressor, the pressure of refrigerant at the suction side will rise above a known upper limit prescribed for normal operation. The invention contemplates that the pressure of refrigerant on the low side of the compressor be monitored and provided to a central processing system or controller, which uses the sensed pressure and an algorithm to detect and correct a reversal of compressor operation. When refrigeration is called for and the refrigeration system enters a chilling cycle, the compressor is initially started and allowed to run for a first period of time to allow system pressures to stabilize and achieve their required and expected values. If after the first period of time monitored suction side pressure is above a predetermined limit and remains above the predetermined limit for a second period of time, the compressor is turned off by the control system. After the compressor has been off for a third period of time, it is restarted and the above described sequence of monitoring suction side pressure is repeated. If after a selected number of trials of shutting off and turning back on the compressor, the measured suction side pressure does not decrease to and remain below its known upper limit, which means that the compressor is continuing to run in reverse mode, the compressor is turned off and the stop and restart process ended, and an error indication is generated. In most cases, by the time the compressor has been turned off and on the condition that produced the reversal in the direction of operation of the scroll compressor will have ceased, so suction side pressure will decrease to within predetermined normal limits and normal operation of the refrigeration system will be restored without loss of service or operation of the frozen product machine.

Figure 1:
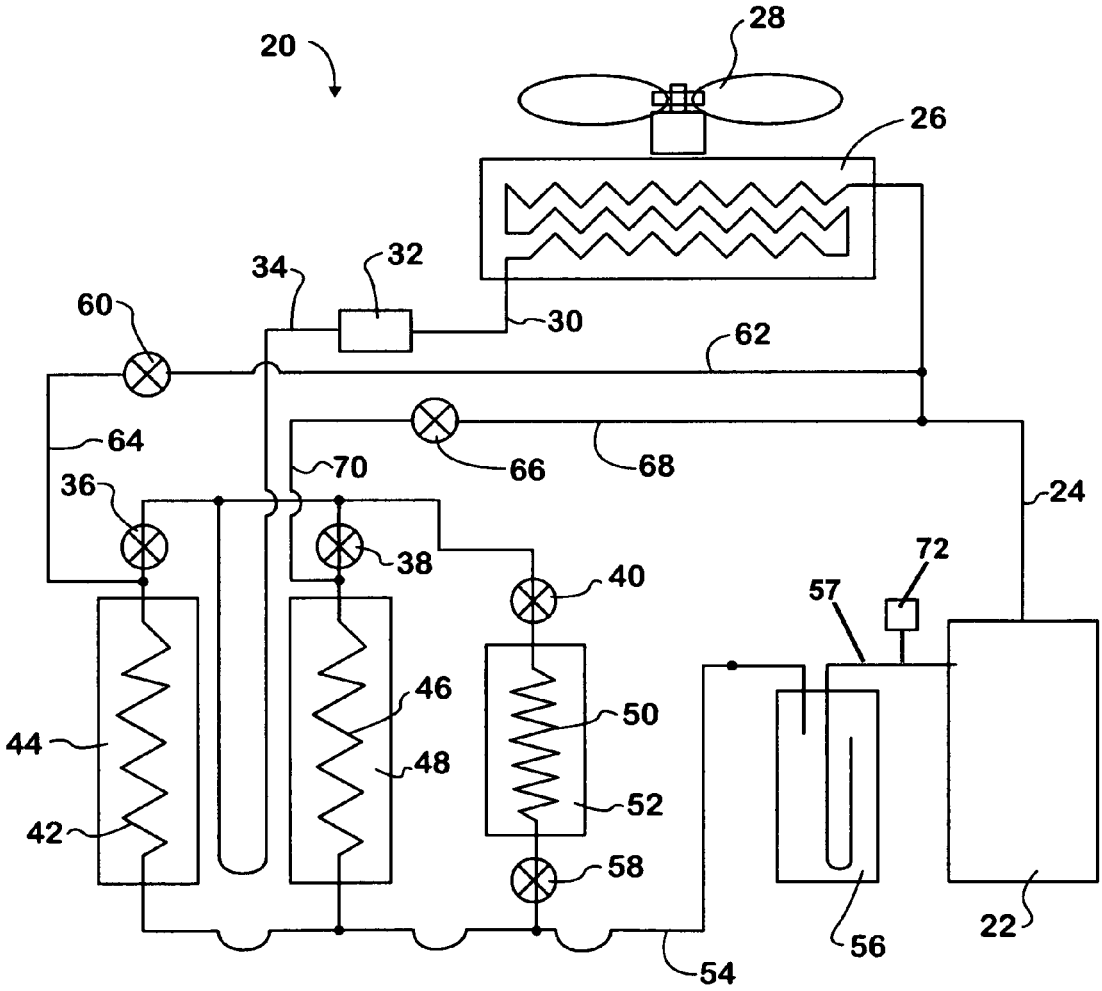
FIG. 1 is a schematic representation of a refrigeration system of a type that may be used in a frozen product machine and with which the teachings of the invention may advantageously be employed.

Referring to FIG. 1, a refrigeration system as may be used with a frozen product dispenser is indicated generally at 20. The refrigeration system may advantageously be of a type used in practice of a prescriptive refrigerant flow control as disclosed in co-pending application Ser. No. 11/974,061, filed Oct. 11, 2007, the teachings of which are incorporated herein by reference. The refrigeration system includes an electric motor driven scroll compressor 22, hot refrigerant at an outlet from which motor/compressor is coupled through a refrigerant line 24 to an inlet to a condenser 26, through which air is drawn by a fan 28 to cool the refrigerant. Cooled refrigerant at an outlet from the condenser flows through a refrigerant line 30 to and through a filter/dryer 32 and a refrigerant line 34 to inlets to each of three electronically controlled expansion valves 36, 38 and 40, which expansion valves may be of the stepper motor driven or pulse valve modulated type, such that the valves may be controlled to meter selected refrigerant flows. Refrigerant exiting an outlet from the expansion valve 36 is delivered to an inlet to an evaporator coil 42 heat transfer coupled to a first beverage product freeze barrel 44 of a frozen product dispenser, which may be a frozen carbonated beverage (FCB) dispenser, to chill the barrel and freeze product in the barrel. Refrigerant exiting an outlet from the expansion valve 38 is delivered to an inlet to an evaporator coil 46 heat transfer coupled to a second product freeze barrel 48 of the dispenser to chill the barrel and freeze product in the barrel. Refrigerant exiting an outlet from the expansion valve 40 is delivered to an inlet to an evaporator coil 50 heat transfer coupled to a pre-chiller 52 of the dispenser to chill the pre-chiller and, as will be described, to chill product flowed through the pre-chiller before the product is delivered into the freeze barrels 44 and 48. After passing through each freeze barrel evaporator 42 and 46, refrigerant exiting the evaporators flows through a refrigerant line 54, an accumulator 56 and a suction line 57 to an inlet to the scroll compressor 22. After passing through the pre-chiller evaporator 50, refrigerant exiting the evaporator flows through an evaporator pressure regulating valve 58 and then through the refrigerant line 54, accumulator 56 and suction line 57 to the inlet to the scroll compressor. The evaporator pressure regulating valve 58 serves to prevent the pressure of refrigerant in the evaporator 50 from falling below a lower limit, thereby to prevent freezing of product in the pre-chiller 52.

The refrigeration system 20 has two defrost circuits, a first one of which is for defrosting the freeze barrel 44 and includes a solenoid operated refrigerant valve 60 having an inlet coupled directly to hot refrigerant at the outlet from the electric motor driven scroll compressor 22 through a refrigerant line 62 and an outlet coupled to the inlet to the freeze barrel evaporator 42 through a refrigerant line, 64. A second defrost circuit is for defrosting the freeze barrel 48 and includes a solenoid operated refrigerant valve 66 having an inlet coupled directly to hot refrigerant at the outlet from the scroll compressor 22 through a refrigerant line 68 and an outlet coupled to the inlet to the freeze barrel evaporator 46 through a refrigerant line 70. In a defrost cycle of the refrigeration system 20, the defrost circuits are operated to heat the evaporators 42 and 46 to warm and defrost the product barrels 44 and 48. In a chilling cycle of the refrigeration system, when the refrigeration system is operated to chill the product freeze barrel 44, the refrigerant valve 60 is closed and the expansion valve 36 is open, and when the refrigeration system is operated in a defrost mode to defrost product in the freeze barrel 44, the refrigerant valve 60 is open and the expansion valve 36 is closed. Similarly, when the refrigeration system is operating to chill the product freeze barrel 48, the refrigerant valve 66 is closed and the expansion valve 38 is open, and when the refrigeration system is operated to defrost product in the freeze barrel 48, the refrigerant valve 66 is open and the expansion valve 38 is closed. A sensor 72 is provided to sense refrigerant pressure in the scroll compressor suction line 57 for a purpose as will be described.

While the refrigeration system 20 is structured to provide chilling for two product freeze barrels, since that enables two different types or flavors of frozen product to be prepared by a frozen product machine, as will be apparent the teachings of the invention may also be used with a frozen product machine that has only a single product freeze barrel, or with one that has more than two product freeze barrels.

Figure 2:
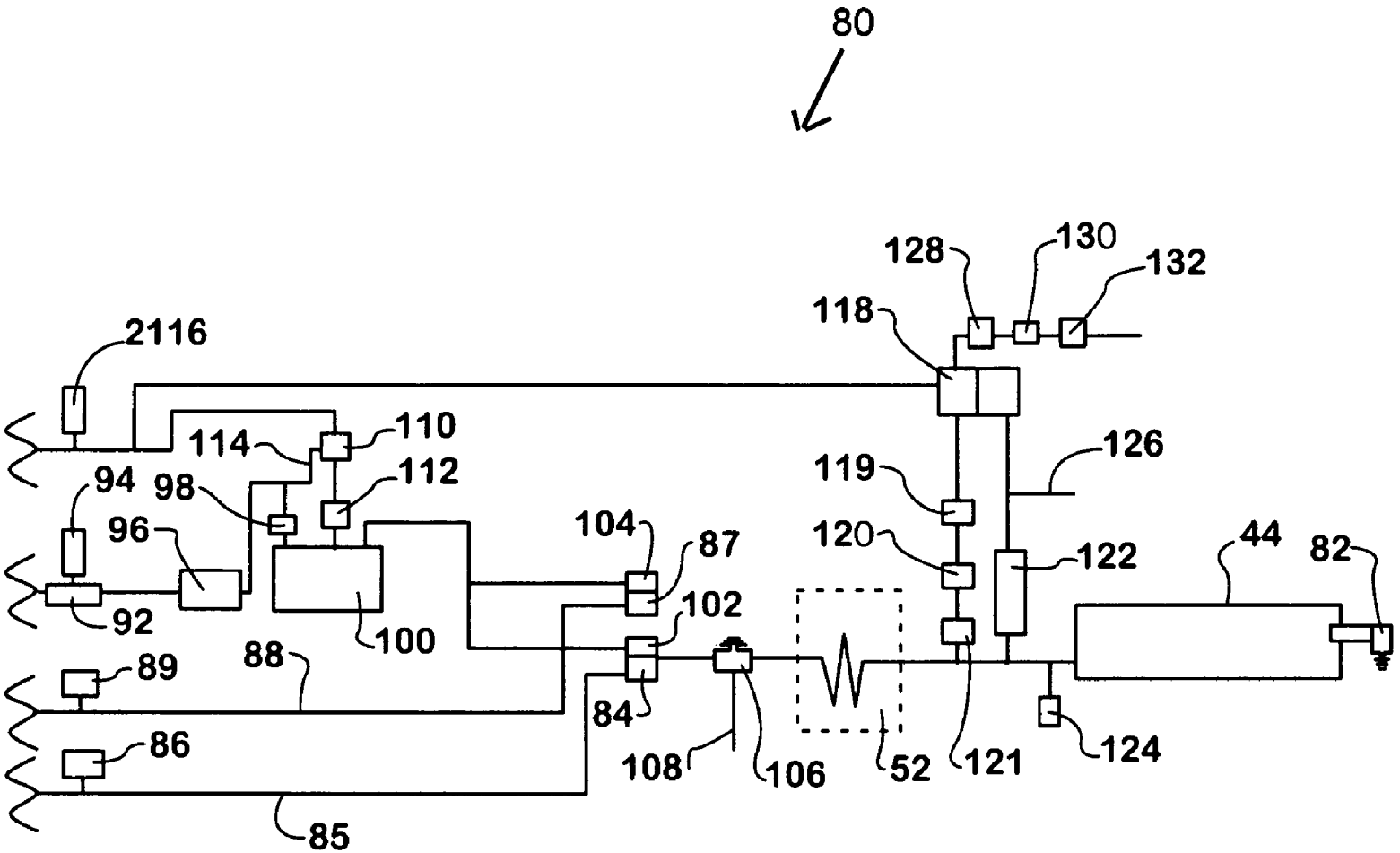
FIG. 2 is a schematic representation of one possible type of frozen beverage dispensing system having two beverage product freeze barrels and a pre-chiller that may be chilled by the refrigeration system of FIG. 1.

One arrangement of FCB dispenser that may utilize the refrigeration system 20 and with which the automatic recovery system of the invention may be used is shown in FIG. 2 and indicated generally at 80. The dispenser includes the two beverage product freeze barrels 44 and 48, only the barrel 44 being shown. This particular embodiment of FCB dispenser utilizes ambient temperature carbonation, and while not specifically shown in FIG. 2 (but shown in FIG. 1), it is understood that the evaporator coil 42 is heat transfer coupled to the barrel 44 to chill the barrel in order to freeze beverage product mixture delivered into the barrel. With reference to the portion of the dispenser 80 shown and associated with the freeze barrel 44, it being understood that a like description applies to a similar but less than fully shown portion of the dispenser associated with the freeze barrel 48, a frozen beverage product dispensing valve 82 is provided on the barrel 44 for service of frozen beverage product to customers. To deliver liquid beverage components into the barrel for being frozen, an externally pumped beverage syrup concentrate is delivered to an inlet to a syrup brixing valve 84 through a syrup line 85, to which line is coupled a sensor 86 for detecting a syrup-out condition. To deliver liquid beverage components to the barrel 48 (shown in FIG. 1), an externally pumped beverage syrup is delivered to an inlet to a syrup brixing valve 87 through a syrup line 88, to which line is coupled a sensor 89 for detecting a syrup-out condition. A potable water supply, such as from a city main, is connected to the dispenser through a strainer/pressure regulator 92, to which is coupled a pressure switch 94 for detecting a water-out condition. From the strainer/pressure regulator the water passes through a carbonator pump 96 and a check valve 98 to a water inlet to a carbonator 100. The carbonator 100 operates in a manner well understood in the art to carbonate water introduced therein, and carbonated water at an outlet from the carbonator is delivered to each of an inlet to a water brixing valve 102 associated with the syrup brixing valve 84 and to an inlet to a water brixing valve 104 associated with the syrup brixing valve 87. The brixing valves 104, 87 comprise an associated pair of brixing valves that delivers a water and syrup mixture, in a selected and adjustable ratio, through an associated fluid circuit (not shown) that includes the pre-chiller 52 and to the freeze barrel 48. The brixing valves 102, 84 also comprise an associated pair of brixing valves that delivers a water and syrup mixture, in a selected and adjustable ratio, through an associated fluid circuit that includes the pre-chiller 52 and to the freeze barrel 44. The water and syrup beverage mixture provided at an outlet from each pair of brixing valves is in a ratio determined by the settings of the individual valves of each pair, and the mixture passed though the brixing valves 102, 84 is delivered through a 3-way valve 106 and the pre-chiller 52 to the freeze cylinder or barrel 44, it being understood that, although not shown (but shown in FIG. 1), the evaporator coil 50 is heat exchange coupled to the pre-chiller. The 3-way valve 106 has an outlet 108 leading to atmosphere, by means of which a sample of the water and syrup mixture output by the pair of brixing valves 102 and 84 may be collected for analysis, so that any necessary adjustments may be made to the brixing valves to provide a desired water/syrup ratio.

To carbonate water in the carbonator tank 100, an externally regulated supply of $CO_2$ is coupled through a temperature compensated pressure regulator 110 and a check valve 112 to the carbonator, the regulator 110 including a capillary sensor 114 for detecting the temperature of incoming water. A sensor 116 detects a $CO_2$-out condition, and the supply of $CO_2$ is also coupled to inlets to each of two $CO_2$ pressure regulators of a manifold 118. An outlet from a first one of the manifold pressure regulators is coupled through a solenoid shut-off valve 119, a $CO_2$ flow control valve 120 and a $CO_2$ check valve 121 to an inlet to the freeze barrel 44. In addition, $CO_2$ at an outlet from a second one of the manifold pressure regulators is coupled to an upper opening to an expansion tank 122, a lower opening to which is coupled to the water and syrup mixture line between the pre-chiller and freeze barrel. The flow control valve 120 accommodates adjustment of the carbonation level in the barrel 44 by enabling the introduction of $CO_2$ into the barrel for a brief period before a mixture of water and syrup is delivered into the barrel. A pressure transducer 124 monitors the pressure of the water and syrup mixture in the barrel 44 and serves as a pressure cut-in/cut-out sensor to control filling and refilling of the barrel with liquid beverage product to be frozen in the barrel. As is understood by those skilled in the art, when the pressure transducer 124 detects a lower limit cut-in pressure in the barrel, for example 23 psi, the pair of brixing valves 102, 84 is opened for delivery of a water and syrup mixture to and into the barrel to refill the barrel, until the pressure transducer detects an upper limit cut-out pressure, for example 29 psi, whereupon the pair of brixing valves is closed. During flow of the water and syrup mixture to the barrel, the mixture is cooled as it flows through an associated circuit in the pre-chiller 52. As the beverage mixture is frozen in the barrel 44 it expands, and the expansion chamber 122 accommodates such expansion.

As mentioned, the dispenser 80 includes the freeze barrel 48 and, therefore, includes further structure (not shown) that is generally duplicative of that to the right of the pair of brixing valves 102, 84 and that accommodates delivery of a water and syrup mixture from the pair of brixing valves 104, 87 to the barrel 48, except that the beverage mixture does not flow through a separate pre-chiller, but instead flows through an associated circuit of the pre-chiller 52. In addition, a line 126 delivers $CO_2$ to an upper opening to an expansion chamber, a lower opening from which couples to an inlet to the barrel 48, and to accommodate addition of $CO_2$ to the barrel 48, the outlet from the manifold first $CO_2$ pressure regulator is also coupled through a solenoid shut-off valve 128, a $CO_2$ flow control valve 130 and a $CO_2$ check valve 132 to the inlet to the barrel.

In operation of the FCB machine 80, liquid beverage components are introduced through the pre-chiller and into the freeze barrels 44 and 48 by their respective pairs of brixing valves 84, 102 and 87, 104. The refrigeration system 20 provides chilling for the pre-chiller 52 via the heat transfer coupled evaporator 50, so that the liquid beverage components delivered into the freeze barrels 44 and 48 are chilled. The refrigeration system also provides chilling for the freeze barrels 44 and 48 via the respective heat transfer coupled evaporators 42 and 46, to freeze the liquid beverage components in the barrels while the components are agitated by associated motor driven beater bar and scraper assemblies, all in a manner understood by those skilled in the art. Frozen beverage product prepared within the freeze barrels is dispensed for service to customers, such a by the dispense valve 82 coupled to the freeze barrel 44.

As discussed, should there be a relatively brief interruption of electric power to the motor/scroll compressor 22 while the refrigeration system 20 is operating in a chilling cycle of one or both of the freeze barrels 44 and 48, because of the resultant flow of refrigerant through the scroll compressor from the high to the suction side of the compressor when the motor is first deenergized, which can cause rotation of the compressor and its drive motor in a reverse or backward direction of operation, it can happen that if electric power is restored while the motor/compressor is still rotating in the reverse direction, the motor can be energized in the reverse direction and will then rotate the compressor in the reverse direction. Under this circumstance, refrigerant is drawn into the compressor high side outlet and pumped out of the compressor suction inlet, and the refrigeration system will overheat and shutdown.

To avoid overheating, shutdown and potential damage to a refrigeration system should a reversal in the direction of rotation or operation of its motor/scroll compressor occur, the invention advantageously provides a control system that detects the occurrence of backward or reverse operation of the motor/scroll compressor and automatically restores proper operation of the motor/scroll compressor. The controller for the refrigeration system is provided with such a control system, which in operation implements an algorithm that, in accordance with one contemplated practice of the invention, may be represented by the flow chart of FIG. 3.

Figure 3:
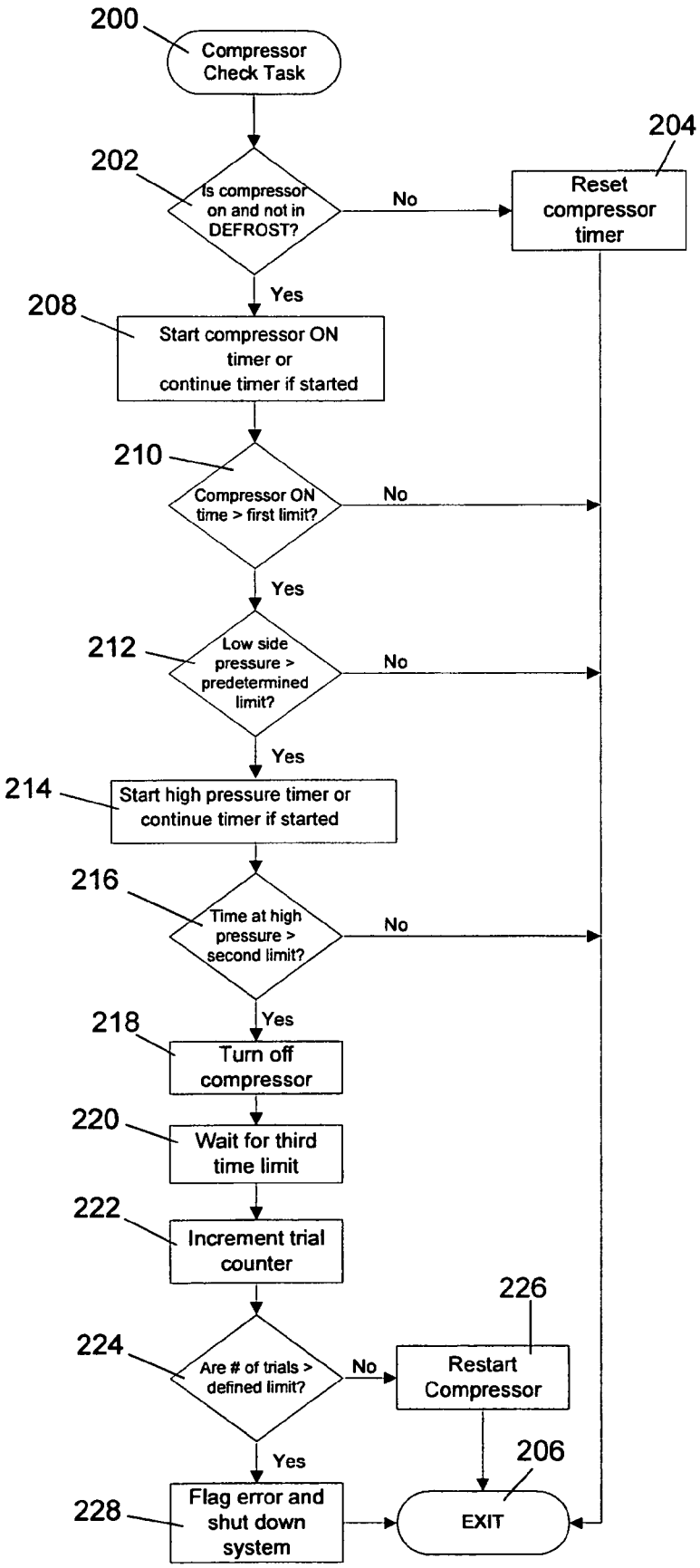
FIG. 3 is a flow chart of an algorithm employed by a control system in operating the refrigeration system of FIG. 1 in accordance with the teachings of the present invention, such that an unexpected operation in a reverse mode of an electric motor driven scroll compressor of the refrigeration system is detected and corrected to restore the refrigeration system to normal operation.

With reference to the FIG. 3 algorithm, at a box 200 there is begun a periodically implemented check for a reversal in the direction of operation of the motor/scroll compressor 22 of the refrigeration system 20. Since the motor/compressor will not enter a reverse mode of operation if the refrigeration system is off or in a defrost cycle at the time of occurrence of a brief interruption of electrical power to the refrigeration system, at a box 202 it is determined whether the motor/compressor is on and, if so, if it being used in a defrost cycle. If the compressor is not on, or if it is on and the refrigeration system is being operated in a defrost cycle, at a box 204 the compressor timers (described below) are reset and at a box 206 algorithm returns to the box 200.

If at the box 202 it is determined that the motor/scroll compressor 22 is on and the refrigeration system 20 is not in a defrost cycle and, therefore, is in a chilling cycle, a check is begun to determine whether the motor/scroll compressor is operating in a reverse mode. This check is begun at a box 208, where a Compressor ON Timer is started at the time of each energization of the motor/scroll compressor when the refrigeration system is in a chilling cycle. At a box 210 the Compressor ON time is compared to a First Time Limit; which First Time Limit is a selected minimum time interval during which the compressor must be operating, upon the refrigeration system being operated in a chilling cycle, before monitored refrigerant pressure at the suction inlet to the compressor, as detected by the sensor 72, can be used to reliably determine whether the motor/compressor is or is not operating in a reverse mode. If the Compressor ON time is not greater than the First Time Limit, at the box 206 the algorithm returns the box 200.

If at the box 210 it is determined that the Compressor ON time is greater than the First Time Limit, at a box 212 a determination is made whether the Low Side Pressure at the suction inlet to the compressor is greater than a Predetermined Limit, which Predetermined Limit has a value selected to be greater than the maximum known pressure that would be reached at the suction inlet in normal, non-reverse operation of the compressor. If the Low Side Pressure is not greater than the Predetermined Limit, at the box 206 the algorithm returns to the box 200. However, if the Low Side Pressure is greater than the Predetermined Limit, then at a box 214 a High Pressure Timer is started, the value of which indicates the time for which monitored Low Side Pressure has been detected to exceed the Predetermined Limit. At a box 216, the value of the High Pressure Timer is compared to a Second Time Limit, the value of which is selected such that if the High Pressure Timer exceeds the Second Time Limit, a determination can be made that the motor/scroll compressor is operating backward in reverse mode. On the other hand, if the value of the High Pressure Timer does not exceed the Second Time Limit, the algorithm returns through the exit box 206 to the start box 200.

If at the box 216 the High Pressure Timer is determined to exceed the Second Time Limit, which indicates that the motor/scroll compressor 22 is running backward, then at a box 218 the motor/compressor is turned off and at a box 220 a timer is started to measure a Third Time Limit, which Third Time Limit is selected to be a length of time that is sufficient for refrigerant pressures in the refrigeration system 20 to normalize to a point that, upon restarting of the motor/compressor, there is an expectation that the motor/compressor will operate in its normal mode and not in a reverse mode. At the end of the Third Time Limit a Trial Counter is incremented at a box 222, which Trial Counter stores a count of the number of times that the motor/compressor has been shut off and then upon starting up again ran in reverse mode, without first running in normal mode. If the count in the Trial Counter is not greater than a selected Defined Limit, which Defined Limit is the number of successive restarts of the motor/compressor in reverse mode that are allowed to occur before it is determined that there is a failure of the system requiring a service call, at a box 226 the motor/compressor is restarted and at a box 206 the algorithm returns to the box 200. However, if at the box 224 the count in the Trial Counter is incremented to a value greater than the Defined Limit, at a box 228 a Flag Error is generated and the system is shut down pending a service call.

In most cases, the condition that produced a reversal in the direction of operation of the motor driven scroll compressor 22, i.e., the brief interruption in power that caused the motor/compressor to shut down and then restart in reverse mode, will have ceased during the Third Time Limit while the motor/compressor are off, such that normal operation of the refrigeration system and frozen product machine will be restored without loss of service or operation of the machine.

Thus, the invention contemplates that upon sensing that an electric motor driven scroll compressor of a refrigeration system is on, a determination be made whether the refrigeration system is in a chilling mode. If it is, then following a first time interval after startup of the compressor, the pressure of refrigerant at the suction side of the compressor is compared with a predetermined upper pressure limit, which predetermined upper pressure limit is chosen to be greater than the maximum pressure anticipated to occur at the suction side of the compressor during normal operation of the refrigeration system. If the monitored suction side pressure of the compressor exceeds the predetermined upper pressure limit for a second time interval, it is an indication that the compressor is operating in reverse and it is turned off. After the compressor has been turned off for a third time interval sufficient for refrigeration system pressures to at least somewhat stabilize, the compressor is restarted and the above described sequence is repeated. Upon the compressor being turned off a selected number of times as a result of continuing to operate in reverse mode following successive startups of the compressor, it is assumed that the reverse mode of operation is not being caused by transient conditions, a system error is generated and the refrigeration system is shut down pending a service call.

If desired, means for detecting an interruption of power to the scroll compressor drive motor can be provided and the algorithm implemented only in response to detecting an interruption, or only in response to detecting an interruption of power while the refrigeration system is operating in a chilling cycle.

It is to be appreciated that while the invention has been described in terms of its use in a refrigeration system for a frozen beverage dispenser, it can also find use with other types of refrigeration systems that utilize an electric motor driven scroll compressor that has the potential of starting up in a reverse mode of operation should a transient electric power interruption occur while the refrigeration system is in a chilling cycle. It also is to be appreciated that if the refrigeration system is always to operate the motor driven scroll compressor in chilling cycles, then in implementing the algorithm it is not necessary to first determine whether the compressor is operating in a defrost cycle.

While embodiments of the invention have been described in detail, various modifications and other embodiments thereof may be devised by one skilled in the art without departing from the spirit and scope of the invention, as defined in the appended claims.

What is claimed is:

1. A control system for a refrigeration system having an electric motor driven compressor, said control system comprising:

means for sensing whether said compressor is on;

first means for determining whether compressor suction side pressure is at least equal to a predetermined pressure at the end of a first time interval following sensing that said compressor is on;

second means for determining whether compressor suction side pressure is at least equal to said predetermined pressure at the end of a second time interval following a determination at the end of said first time interval that compressor suction side pressure is at least equal to said predetermined pressure;

means for turning off said motor driven compressor for a third time interval in response to a determination at the end of said second time interval that compressor suction side pressure is at least equal to said predetermined pressure; and means for turning on said motor driven compressor at the end of said third time interval.

2. A control system as in claim 1, wherein said electric motor driven compressor is an electric motor driven scroll compressor.

3. A control system as in claim 1, wherein said refrigeration system is operable in both chilling and defrost cycles, said sensing means further senses whether said compressor is on in a defrost cycle of said refrigeration system, and said first means for determining is responsive to said sensing means sensing that said compressor is on but not in a defrost cycle of said refrigeration system for determining whether compressor suction side pressure is at least equal to said predetermined pressure at the end of said first time interval.

4. A control system as in claim 1, further including:

counter means for storing a count of the number of successive times that said compressor is turned off by said means for turning off said compressor; and means responsive to the count in said counter means reaching a selected count for terminating operation of said refrigeration system.

5. A controller for a refrigeration system having an electric motor driven compressor, said refrigeration system comprising:

means for monitoring refrigerant pressure at a suction side of said compressor;

means responsive to monitored suction pressure being at least equal to a predetermined pressure at selected times after said motor driven compressor is turned on for turning off said motor driven compressor; and means for turning on said motor driven compressor a predetermined time after said means responsive turns off said compressor.

6. A controller as in claim 5, wherein said refrigeration system compressor is a scroll compressor.

7. A controller as in claim 5, including a frozen product dispenser, said refrigeration system having an evaporator heat exchange coupled to a freeze barrel of said frozen product dispenser and being operable to turn on said compressor in each of chilling and defrost cycles of said refrigeration system to chill and defrost said freeze barrel.

8. A controller as in claim 7, including:

means for sensing when said compressor is on in a chilling cycle of said refrigeration system;

first timer means responsive to said sensing means sensing that said compressor is on in a chilling cycle of said refrigeration system for initiating timing of a first time interval; and second timer means for initiating timing of a second time interval at the end of said first time interval if at the end of said first time interval monitored refrigerant pressure at said compressor suction side is at least equal to said predetermined pressure, said first and second time intervals being said selected times.

9. A controller as in claim 8, including:

counter means for storing a count of the number of times said compressor is successively turned off by said means responsive and then turned on by said means for turning on; and means responsive to a selected count in said counter means for terminating operation of said refrigeration system.

10. A refrigeration system having an electric motor driven scroll compressor operable in chilling and defrost cycles of said refrigeration system, said refrigeration system comprising:

means for energizing said electric motor to turn on said compressor;

means for monitoring refrigerant pressure at a suction side of said compressor;

first timer means responsive to said compressor being turned on in a chilling cycle of said refrigeration system to initiate timing of a first time interval;

first means for comparing monitored compressor suction side pressure to a predetermined pressure and for generating a first signal if said monitored pressure is at least equal to said predetermined pressure at the end of said first time interval;

second timer means responsive to generation of said first signal to initiate timing of a second time interval;

second means for comparing monitored compressor suction side pressure to the predetermined pressure and for generating a second signal if said monitored pressure is at least equal to said predetermined pressure at the end of said second time interval;

means responsive to generation of said second signal for de-energizing said electric motor to turn off said compressor;

third timer means responsive to generation of said second signal for initiating timing of a third time interval; and means for re-energizing said electric motor at the end of said third time interval to turn on said compressor in a chilling cycle of said refrigeration system.

11. A refrigeration system as in claim 10, including:

counter means for counting the number of successive times that said electric motor is de-energized due to compressor suction side pressure being at least equal to said predetermined pressure at the end of said second time interval; and means responsive to said counter means reaching a selected count to terminate operation of said refrigeration system.

12. A method of controlling a refrigeration system having an electric motor driven scroll compressor, said method comprising the steps of:

energizing the electric motor to operate the compressor;

monitoring refrigerant pressure at a suction side of the compressor;

determining whether monitored refrigerant pressure is at least equal to a predetermined pressure both after expiration of a first time interval following energization of the motor and after expiration of a second time interval following expiration of the first time interval;

de-energizing the motor to turn off the compressor for a third time interval in response to said determining step determining that monitored compressor suction side pressure is at least equal to the predetermined pressure after expiration of each of the first and second time intervals; and re-energizing the electric motor to operate the compressor following expiration of the third time interval.

13. A method of controlling a refrigeration system having an electric motor driven compressor, said method comprising the steps of:

sensing whether the compressor is on;

determining whether compressor suction side pressure is at least equal to a predetermined pressure at the end of a first time interval following said sensing step sensing that the compressor is on;

ascertaining, in response to said determining step determining that compressor suction side pressure is at least equal to the predetermined pressure at the end of the first time interval, whether compressor suction side pressure is at least equal to the predetermined pressure at the end of a second time interval following the first time interval;

turning off the motor driven compressor for a third time interval in response to said ascertaining step ascertaining that compressor suction side pressure is at least equal to the predetermined pressure at the end of the second time interval; and turning on the motor driven compressor at the end of the third time interval.

14. A method as in claim 13, wherein the electric motor driven compressor is a scroll compressor.

15. A method as in claim 13, wherein the refrigeration system is operable in chilling and defrost cycles, said sensing step senses whether the compressor is on in a defrost cycle of the refrigeration system, and said determining step is responsive to said sensing step sensing that the compressor is on but not in a defrost cycle of the refrigeration system to determine whether compressor suction side pressure is at least equal to the predetermined pressure at the end of the first time interval.

16. A method as in claim 13, including the steps of:

counting the number of successive times of performance of said turning off step; and terminating operation of the refrigeration system upon said counting step reaching a predetermined count.

17. A method of controlling a refrigeration system having an electric motor driven scroll compressor operable in chilling and defrost cycles of the refrigeration system, said method comprising the steps of:

energizing the electric motor to turn on the compressor;

monitoring refrigerant pressure at a suction side of the compressor;

sensing whether the compressor is on in a defrost cycle of the refrigeration system;

initiating timing of a first time interval in response to said sensing step sensing that the compressor is on and not in a defrost cycle of the refrigeration system;

determining, after expiration of the first time interval, whether monitored pressure at the suction side of the compressor is at least equal to a predetermined pressure;

initiating timing of a second time interval in response to said determining step determining that monitored compressor suction side pressure is at least equal to the predetermined pressure after expiration of the first time interval;

ascertaining, after expiration of the second time interval, whether monitored compressor suction side pressure is at least equal to the predetermined pressure;

turning off the compressor in response to said ascertaining step ascertaining that monitored compressor suction side pressure is at least equal to the predetermined pressure after expiration of the second time interval;

initiating timing of a third time interval in response to performance of said turning off step; and re-energizing the electric motor to turn on the compressor in a chilling cycle of the refrigeration system after expiration of the third time interval.

18. A method as in claim 17, including the steps of:

counting the number of times of expiration of the third time interval; and terminating operation of the refrigeration system upon said counting step reaching a selected count.

* * * * *